US007178214B1

(12) United States Patent
Wilson

(10) Patent No.: US 7,178,214 B1
(45) Date of Patent: Feb. 20, 2007

(54) SAW BLADE GRIP TOOL

(75) Inventor: Keith R. Wilson, Cedar Falls, IA (US)

(73) Assignee: Hiqol L.C., Ceder Falls, IA (US)

( * ) Notice: Subject to any disclaimer, the term of this patent is extended or adjusted under 35 U.S.C. 154(b) by 153 days.

(21) Appl. No.: 10/849,594

(22) Filed: May 20, 2004

Related U.S. Application Data

(60) Provisional application No. 60/472,294, filed on May 21, 2003.

(51) Int. Cl.
*B25B 27/14* (2006.01)

(52) U.S. Cl. ..... 29/281.1

(58) Field of Classification Search ..... 81/313, 81/3.44, 3.9; 269/239, 3, 6; 29/281.1, 281.5, 29/267, 268
See application file for complete search history.

(56) References Cited

U.S. PATENT DOCUMENTS

| | | | | |
|---|---|---|---|---|
| 102,923 | A | | 5/1870 | Disston |
| 716,785 | A | | 12/1902 | Taylor |
| 2,918,165 | A | | 12/1959 | Paulick, Jr. |
| 3,389,622 | A | * | 6/1968 | Gunter ..... 81/3.09 |
| 4,246,818 | A | | 1/1981 | McGraw, Jr. |
| 4,541,528 | A | * | 9/1985 | Holmes ..... 206/82 |
| 4,715,492 | A | | 12/1987 | Holmes |
| 4,899,482 | A | * | 2/1990 | Gerdes ..... 43/4 |
| 5,078,266 | A | | 1/1992 | Rackley |
| 5,188,011 | A | | 2/1993 | Somal et al. |
| 5,983,480 | A | | 11/1999 | Fontaine et al. |
| 6,267,239 | B1 | | 7/2001 | Maki |

* cited by examiner

*Primary Examiner*—Robert C. Watson
(74) *Attorney, Agent, or Firm*—Boyle, Fredrickson, Newholm, Stein & Gratz, S.C.

(57) ABSTRACT

A tool for engaging a saw blade to facilitate attachment and removal of the blade from a saw includes a pair of opposed portions pivotally connected to one another for movement between an open position and a closed position. The pair of opposed portions are engageable with the teeth or tips of the blade. Each of the opposed portions includes an engaging wall capable of retaining the blade on the tool as the blade is attached to or removed from a saw or the like, and a handle for facilitating movement of the pair of opposed portions between the open and closed positions.

15 Claims, 6 Drawing Sheets

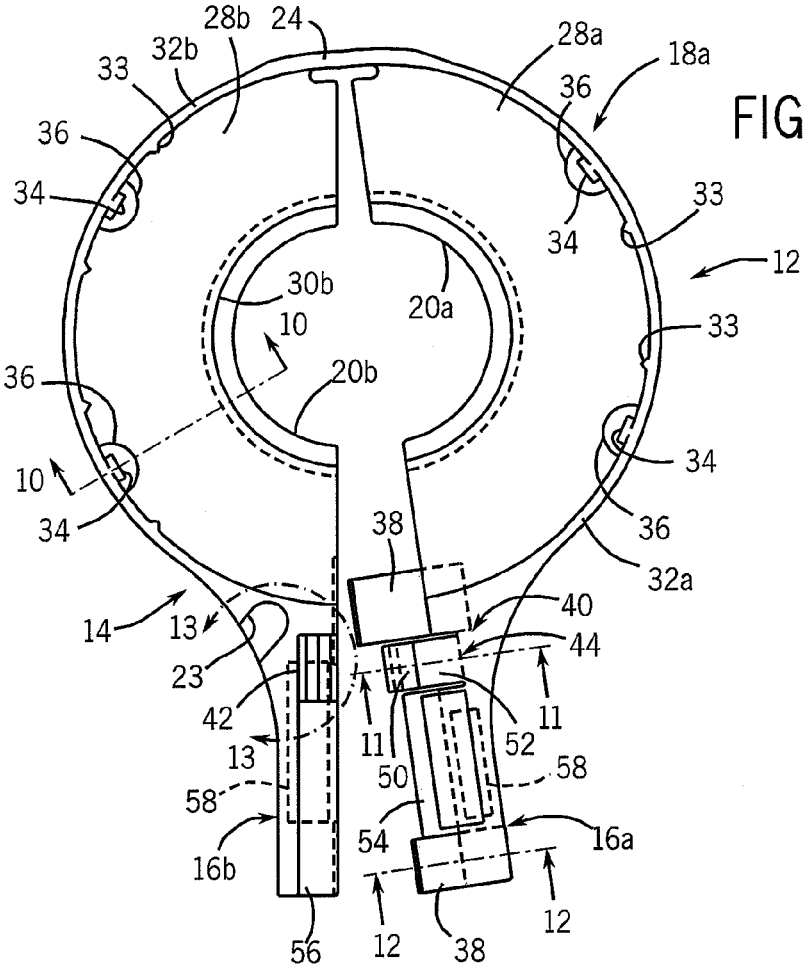
FIG. 8
FIG. 10
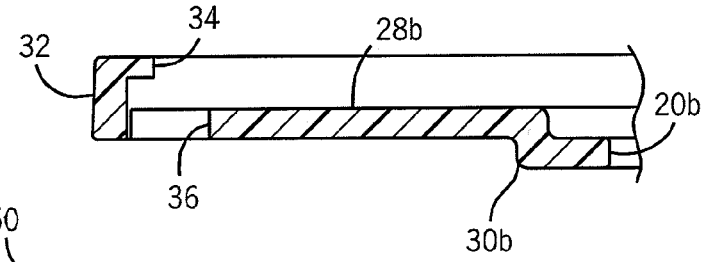
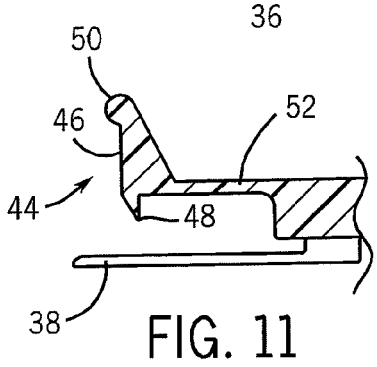
FIG. 11
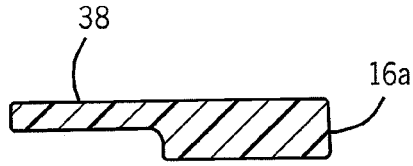
FIG. 12

FIG. 9
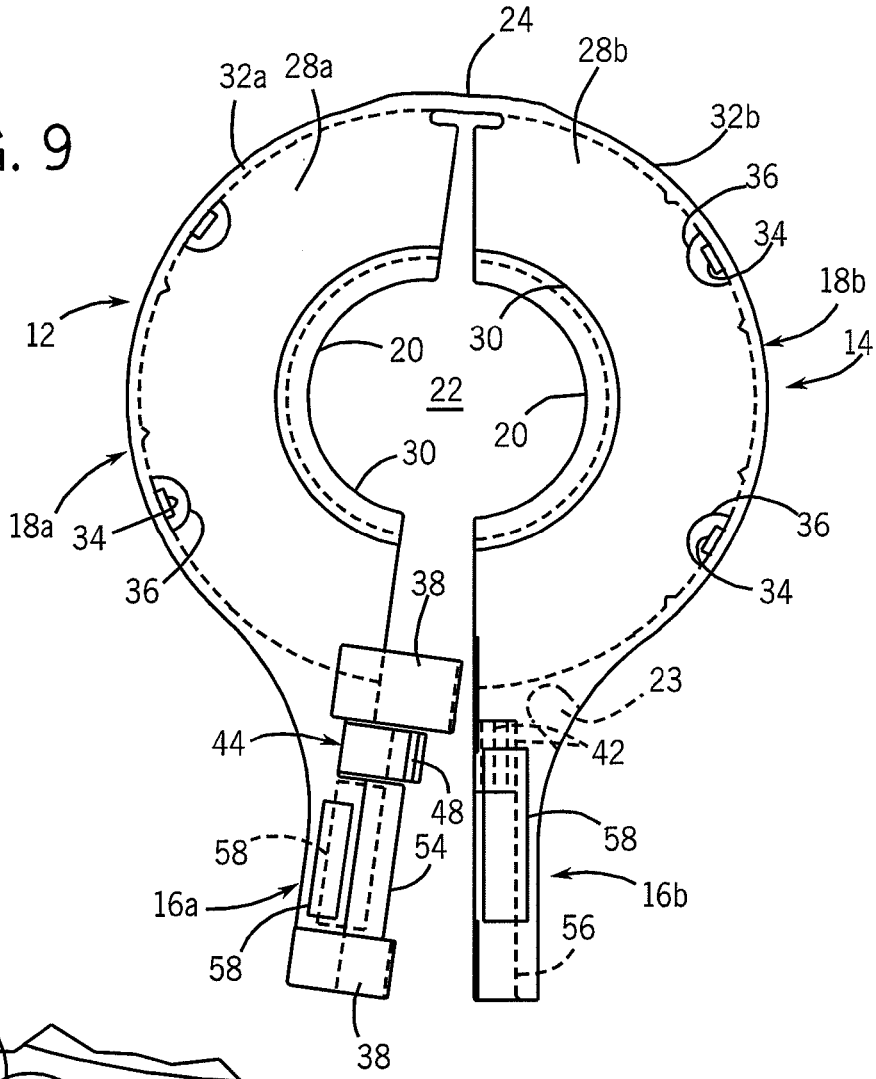
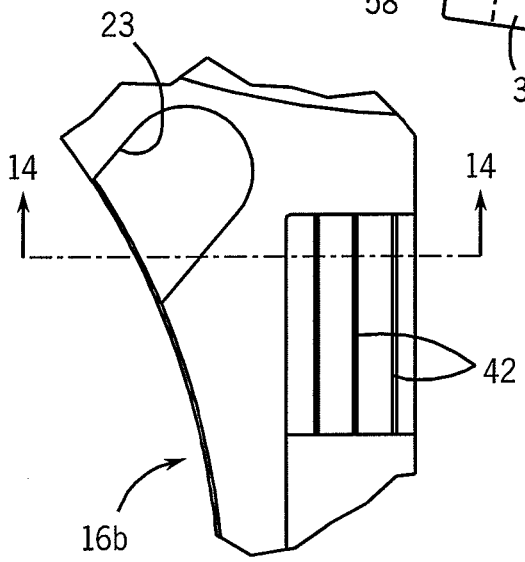
FIG. 13
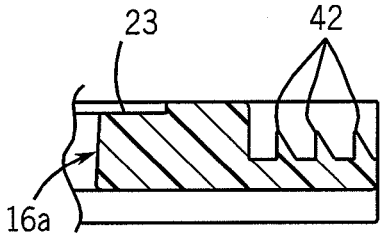
FIG. 14

SAW BLADE GRIP TOOL

CROSS REFERENCE TO RELATED APPLICATIONS

This application claims priority from U.S. Provisional Patent Application Ser. No. 60/472,294, which was filed on May 21, 2003.

BACKGROUND OF THE INVENTION

When utilizing a powered saw, such as a table saw, circular saw, radial arm saw, powered miter saw, etc., to cut material such as wood, the saw blade must often be removed for sharpening, or replaced with a different type of blade for different materials or types of cuts. The process of removing or disengaging the blade from the saw is generally time consuming and awkward, as the blade must be held stationary while a user loosens the nut that holds the blade in position on the rotating shaft of the saw. This is especially the case for a table saw, in which the blade is located within an opening in the table and includes portions located above and portions located below the upper surface of the table.

When holding and removing the blade, care must be taken to ensure that the blade does not injure the person or persons removing the blade. Such injuries can occur when the blade is inadvertently moved in the process of disengaging the blade from the saw. To prevent this, oftentimes an obstruction, such as a wood block, is jammed into engagement with the teeth of the blade by the user to prevent rotation of the blade. The obstruction is typically positioned between the blade and the table supporting the saw. However, the teeth of the blade remain exposed during the process of loosening or tightening the nut that holds the blade on the rotating shaft of the saw, which presents the potential for the user's hands or fingers to come into contact with and be injured by the teeth of the blade when loosening and/or tightening the nut.

In addition, in order to remove a blade or place a blade on the shaft, the blade normally must be moved laterally and vertically with respect to the table due to the positioning of the blade within the opening in the table. Thus, when the blade is being removed from or installed on the shaft, the user must physically grasp the blade in order to slide and/or lift the blade off the shaft or to move the blade onto the shaft. This increases the potential for the user to come into contact with the teeth of the blade, or for the blade teeth to be damaged during handling, such as by the user inadvertently dropping the blade into the saw or onto a hard surface, such as a floor on which the table saw is supported.

Therefore, it is desirable that a device be developed that enables a user to safely grasp the saw blade in a secure manner without contacting the teeth, and which also enables the user to hold the blade in a manner which greatly reduces the potential for the blade to be inadvertently dropped and damaged. It is also desirable for the device to have a relatively simple construction to provide low cost and ease of manufacture, as well as simplicity in operation.

SUMMARY OF THE INVENTION

It is a primary object of the present invention to provide a device or tool that can be used to grasp a saw blade to enable removal or installation of the blade, and which securely holds the blade without any direct contact between the blade and the user utilizing the tool.

It is another object of the present invention to provide a tool that is able to both hold the blade during installation and removal of the blade, and during transportation of the blade to or from the saw.

It is still another object of the present invention to provide a tool that has a relatively simple and easy to use construction, enabling the tool to be utilized by a wide variety of users for use in installing and removing a blade.

The tool of the present invention has been developed to enable a user to immobilize and securely hold a saw blade while disengaging the blade from a powered saw, in order to avoid contact with the sharp edges or teeth of the blade. The tool includes a pair of opposed sections movably secured to one another, with each section including a blade-gripping portion and a handle portion. Each blade-gripping portion includes one section of a blade sleeve, which is adapted to be positioned around the saw blade and to engage the outer teeth of the saw blade. The blade sleeve forms an enclosure that has a transverse inner dimension that is variable based on the positioning of the opposed sections of the tool with respect to one another, to accommodate a large number of blade diameters. Further, to prevent the tool from being inadvertently disengaged from the blade, the tool can include a securing mechanism to hold the tool on the blade until such time as the mechanism is disengaged.

Numerous other advantages, features and objects of the invention will be made apparent from the following detailed description taken together with the drawing figures.

BRIEF DESCRIPTION OF THE DRAWINGS

The drawings illustrate the best mode currently contemplated of practicing the present invention.

In the drawings:

FIG. 8 is a top plan view of a second embodiment of the blade gripping tool in accordance with the present invention;

FIG. 9 is a bottom plan view of the blade gripping tool of FIG. 8;

FIG. 10 is a partial cross-sectional view along line 10—10 of FIG. 8;

FIG. 11 is a partial cross-sectional view along line 11—11 of FIG. 8;

FIG. 12 is a partial cross-sectional view along line 12—12 of FIG. 8;

FIG. 13 is a an enlarged partial top plan view showing a portion of the blade gripping tool, with reference to line 13—13 of FIG. 8; and FIG. 14 is a partial cross-sectional view along line 14—14 of FIG. 13.

DETAILED DESCRIPTION OF THE INVENTION

Figure 1:
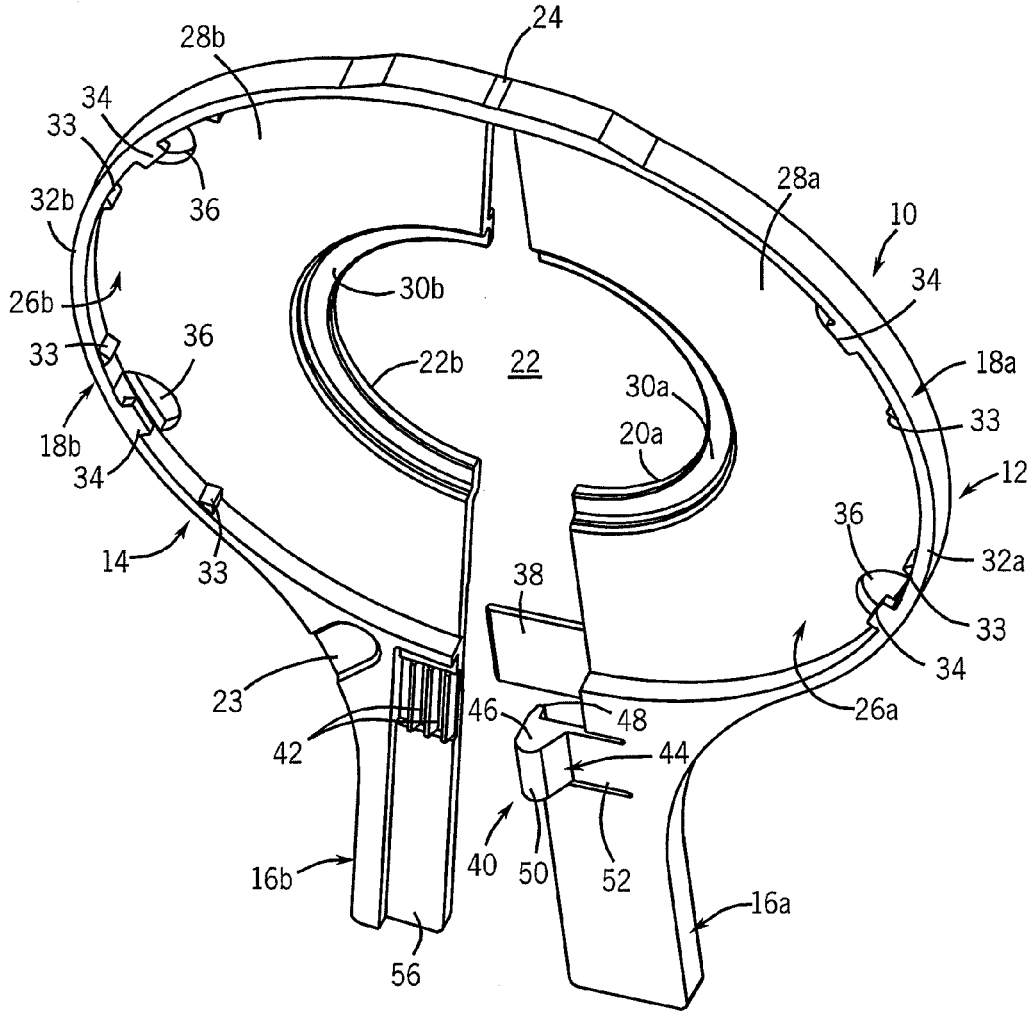
FIG. 1 is an isometric view of the saw blade gripping tool in accordance with the present invention.

With reference now to the drawing figures in which like reference numerals designate like parts throughout the disclosure, a blade-gripping tool or device constructed according to a first embodiment of the present invention is indicated generally at 10 in FIGS. 1–7. The tool 10 includes a first section or half 12 and second section or half 14 formed similarly to each other. First half 12 includes a handle portion 16*a* and a blade engaging portion 18*a*, and second half 14 includes a handle portion 16*b* and a blade engaging portion 18*b*. Each blade-engaging portion 18*a*, 18*b* is generally semicircular in shape, and is formed so as to define respective central semicircular notches 20*a*, 20*b*. Alternatively, depending upon the shape of the particular blade to be removed using the tool 10, the blade engaging portions 18*a*, 18*b* can have any necessary or desired shape.

When the blade engaging portions 18*a*, 18*b* are positioned adjacent one another, the respective notches 20*a*, 20*b* serve to form a circular opening 22 in the center of the tool 10. The size of the opening 22 defined by the opposed notches 20 can vary, but is sufficient to provide clearance around a nut 100 (FIG. 6) that is used to hold a blade B in engagement with a collar having a shaft 104, and to enable a user to engage another implement (not shown), such as a wrench or ratchet, with the nut 100.

Opposite the handle portions 16*a*, 16*b*, the respective blade engaging portions 18*a*, 18*b* are pivotally secured to one another utilizing a living hinge 24 or other suitable pivoting mechanism. The hinge 24 allows the first half 12 and the second half 14 to be moved toward and away from each other, in order to enable the tool 10 to be releasably positioned around and removed from a saw blade B. While the hinge 24 is shown as a living hinge integrally formed with each half 12 and 14, the hinge 24 can also be a separate component of the tool 10, such as any conventional pin-type or other hinge construction. Further, while the hinge 24 shown in the drawing figures is not separately biased, the hinge 24 can also be constructed to be biased such that the halves 12 and 14 of the tool 10 are urged into either the closed position or the open position. This provides added benefit in either preventing the tool 10 from being inadvertently disengaged from the blade B, or in facilitating disengagement of the tool 10 from the blade B. In addition, while the halves 12 and 14 are shown as being interconnected via a pivoting connection, i.e., the hinge 24, it is contemplated that halves 12 and 14 may be interconnected by any other non-pivoting mechanism that enables halves 12 and 14 to be moved toward and away from each other, e.g. a slide-type mechanism or the like.

Referring now to FIGS. 1, 2, 4, 6 and 7, in order to enable the tool 10 to securely engage the outer periphery of the saw blade B in a manner which prevents any blade teeth on the blade B from being exposed, halves 12 and 14 include respective blade sleeve sections 26*a*, 26*b* forming a part of respective blade engaging portions 18*a*, 18*b*. The sleeve sections 26*a* and 26*b* are formed of a generally rigid, but formable material, such as a plastic material. Blade sleeve sections 26*a*, 26*b* have a generally semicircular shape and include respective flat walls 28*a*, 28*b* which in a preferred embodiment have respective central semicircular recesses 30*a*, 30*b* formed along the periphery of the respective notches 20*a*, 20*b* in respective blade engaging portions 18*a*, 18*b*. The recesses 30*a*, 30*b* enable the opening 22 in the tool 10 to accommodate blades B that have thickened center or mounting portions. Sleeve sections 28*a*, 28*b* also include respective outwardly extending outer walls 32*a*, 32*b* that extend perpendicularly from the end of respective flat walls 28*a*, 28*b* located opposite the recesses 30*a*, 30*b*, respectively. The outer walls 32*a*, 32*b* have a width greater than the thickness of the blade B, such that the tips or teeth T of the blade B are completely covered by the outer walls 32*a*, 32*b* when the halves 12, 14 are moved together into engagement with the outer periphery of blade B. The surfaces of the outer walls 32*a*, 32*b* that engage the teeth T are preferably smooth, but can alternatively be formed with ribs 33 or grooves, knobs or roughened sections (not shown) to increase the frictional engagement between the walls 32*a*, 32*b* and the teeth T, and help prevent rotation of the blade B relative to the tool 10. The width of the outer walls 32*a*, 32*b* is also selected to enable the walls 32*a*, 32*b* and tool 10 to be easily inserted into an opening in a table saw (not shown) and positioned around the blade B disposed in the opening without the periphery of the opening interfering with the positioning of the tool 10.

Further, in order to retain the blade B within sleeve sections 28*a*, 28*b* on the tool 10, sleeve sections 26*a*, 26*b* also includes a number of tabs 34 extending inwardly from the edge of outer walls 32*a*, 32*b* opposite the respective flat walls 26, 26*b* toward the respective recesses 30*a*, 30*b*. Preferably, the tabs 34 are spaced equidistant from one another around the outer walls 32*a*, 32*b*, but can be positioned in any configuration or number on sleeve sections 26*a*, 26*b*. The tabs 34 serve to obstruct the movement of the teeth T of the blade B within each sleeve section 26, in order to maintain the blade B within the tool 10 until such time as the tool 10 is disengaged from the blade B. The tabs 34 can preferably be disposed directly above openings 36 in the flat walls 26*a*, 26*b*, which facilitate formation of tabs 34 in a molding operation, and which also enable a user to visually determine the placement of the blade B within the tool 10. More particularly, the openings 36 enable the user to see the teeth T of the blade B positioned beneath the tabs 34, to ensure that the blade B is properly engaged by the tool 10. Further, because the respective halves 12 and 14 of the tool 10 preferably pivot with respect to one another, the effective diameter of the tool 10, and the spacing of the outer walls 32*a*, 32*b* and tabs 34*a*, 34*b*, can be varied as necessary in order to accommodate circular blades B having varying diameters.

Figure 2:
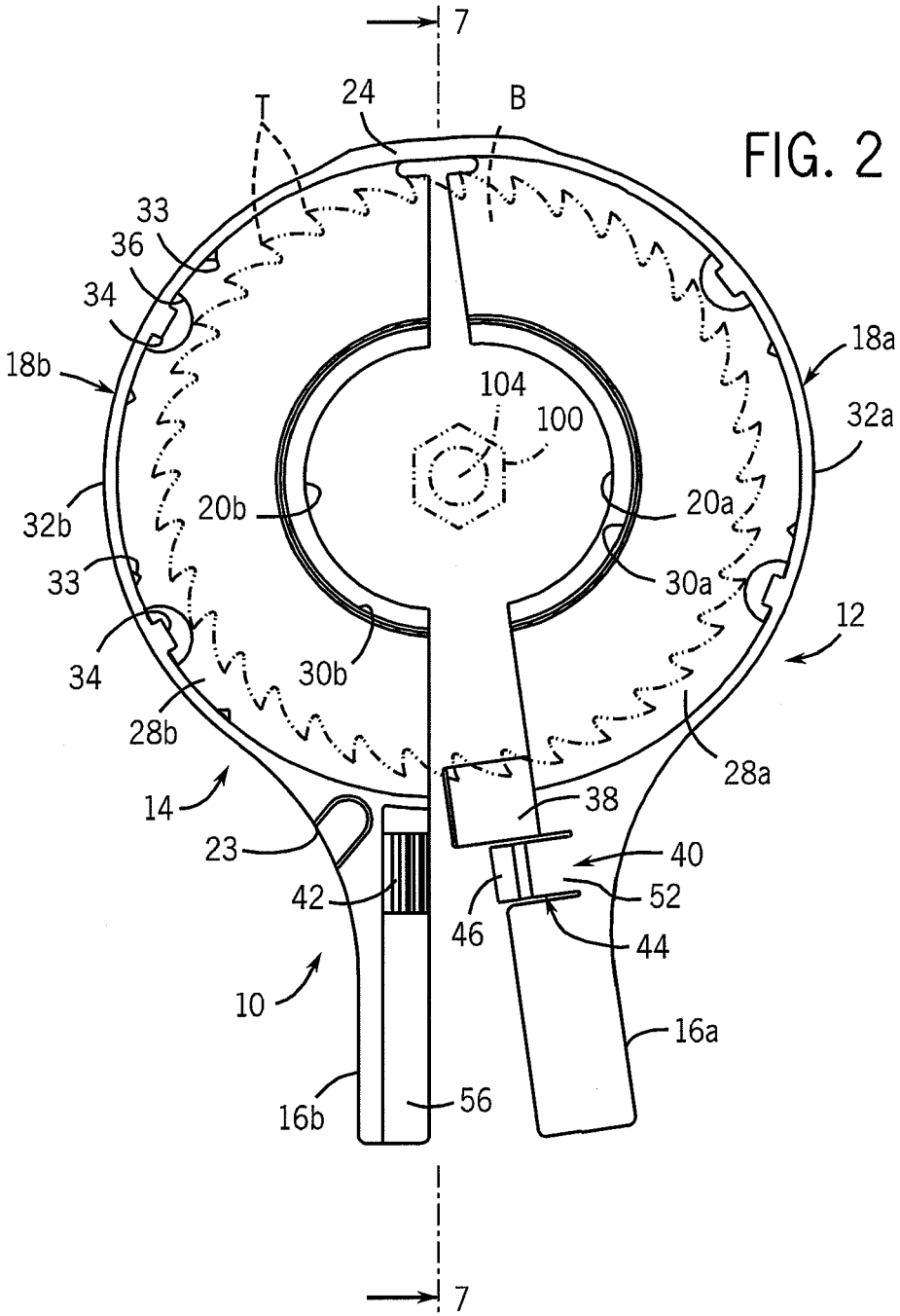
FIG. 2 is a top plan view of the saw blade gripping tool of FIG. 1, showing the tool in an open position around a blade that is adapted to be removed from a powered saw.
Figure 3:
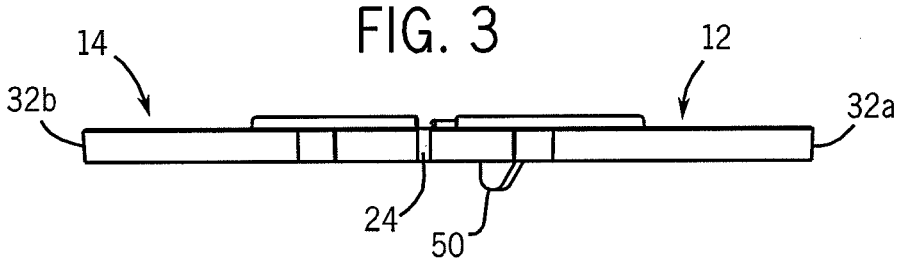
FIG. 3 is a front elevation view of the saw blade gripping tool of FIG. 1.
Figure 4:
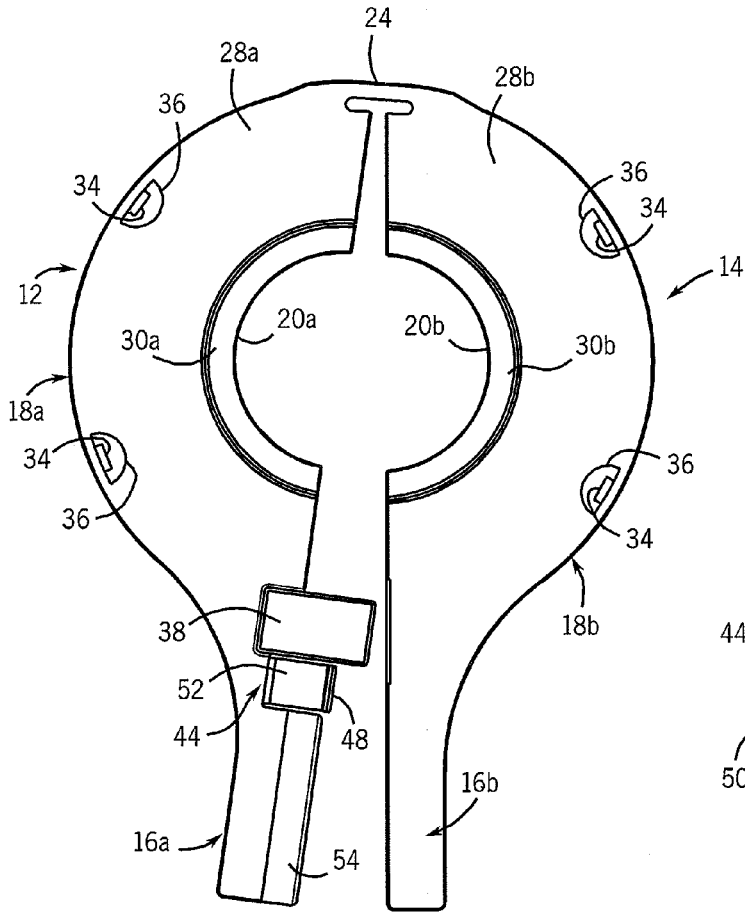
FIG. 4 is a bottom plan view of the saw blade gripping tool of FIG. 1.
Figure 5:
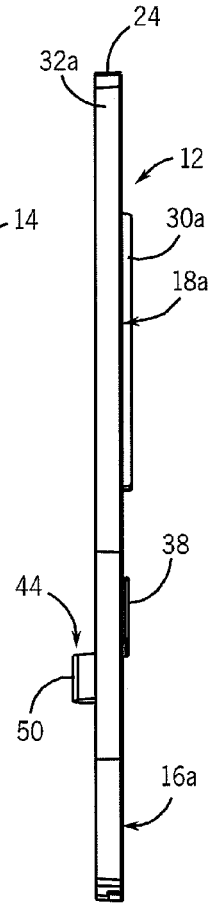
FIG. 5 is a rear elevation view of the saw blade gripping tool of FIG. 1.
Figure 6:
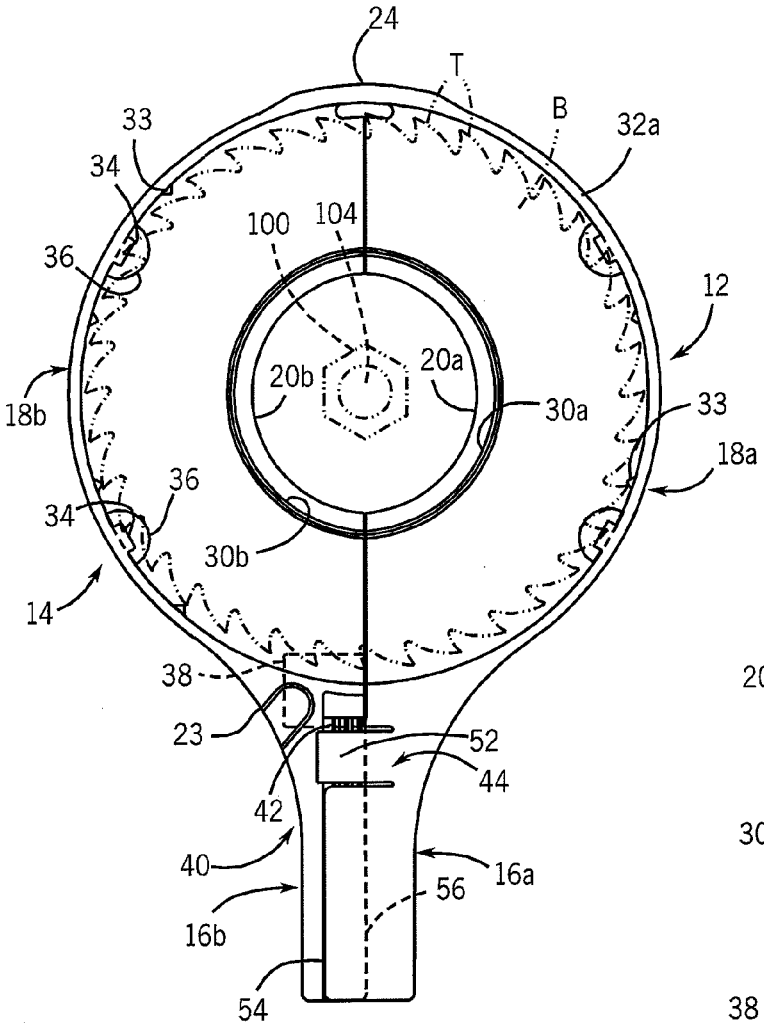
FIG. 6 is a top plan view similar to FIG. 2, showing the saw blade gripping tool in a closed position and engaged with the blade.
Figure 7:
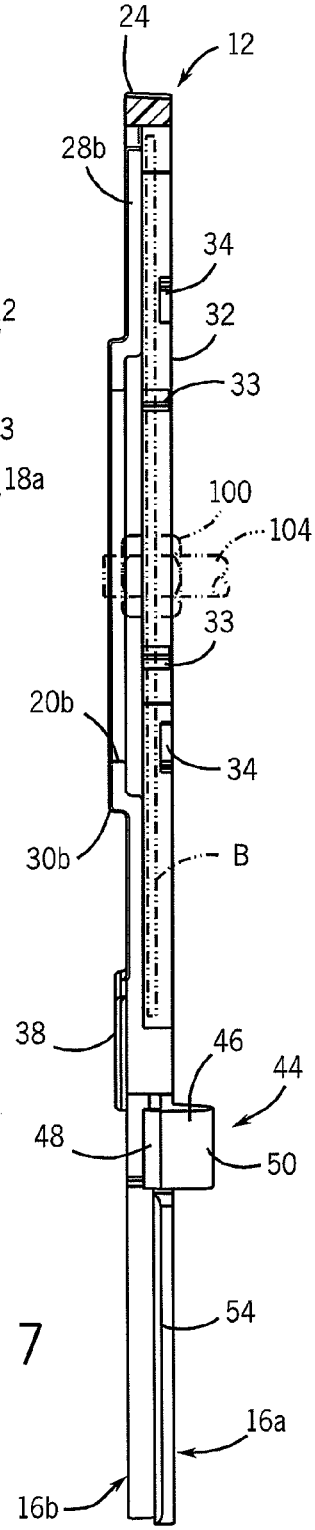
FIG. 7 is a cross-sectional view along line 7—7 of FIG. 2.

In operation, when the tool 10 is utilized to remove a blade B from a shaft 104, the tool 10 is initially positioned adjacent the blade B, such as within the opening in a saw table housing the blade B, and the handle portions 16*a*, 16*b* are utilized to move the halves 12 and 14 away from one another to an open position as shown in FIGS. 1 and 2. When the halves 12 and 14 are opened in this manner, the tool 10 can be positioned adjacent the blade B and moved laterally toward the blade B, so that blade B is received in the area or enclosure defined between the outer walls 32*a*, 32*b*. When the tool 10 is in the open position, such movement toward blade B causes the flat walls 28*a*, 28*b* of the respective sleeve sections 26*a*, 26*b* to engage the flat outwardly facing surface of blade B, with the outer walls 32*a*, 32*b* being disposed outwardly of the blade teeth T. Notches 20*a*, 20*b* provide clearance for nut B and shaft 104 as tool 10 is moved laterally into engagement with blade B. The handle portions 16*a* and 16*b* are then used to move the respective halves 12 and 14 to the closed position, in which outer walls 32*a*, 32*b* are moved into engagement with the teeth T of the blade B to position the blade B between the tabs 34 and the respective outer walls 28*a*, 28*b*, as shown in FIGS. 6 and 7. In this position, the notches 20*a*, 20*b* and recesses 30*a*, 30*b* on respective halves 12 and 14 form the opening 22 through which the nut 100 and shaft 104 extend. The user can then utilize a separate implement, such as a ratchet-type socket wrench (not shown) or other suitable device, to disengage the nut 100 without contacting the blade B. Also, depending upon the particular configuration of the nut 100 or the type of attachment used to secure the blade B to the shaft 104, the handle portions 16*a*, 16*b* can be utilized to rotate the tool 10 and the blade B in order to move the outwardly extending handle portions 16*a*, 16*b* with respect to the shaft 104, in order to give the user unobstructed access to the nut 100.

When the tool 10 is positioned around the blade B and moved to the closed position as described, the user continues applying a gripping force to handle portions 16*a*, 16*b*, using an optional finger recess 23 on half 16*b*, in order to maintain the tool 10 in the closed position and in engagement with the blade B. The user maintains the grip on the handle portions 16*a*, 16*b* of the tool 10 to hold the blade B and also to resist any tendency of blade B to turn with the shaft 104 as torque is applied to the nut 100. This can be also accomplished by rotating the tool 10 until one of handle portions 16*a*, 16*b* engages an edge of a saw table on which blade B is mounted, and applying a force to the other of handle portions 16*a*, 16*b* that clamps the blade B between the halves 12, 14 and prevents rotation of the tool 10 and blade B relative to the saw table. Once the nut 100 has been removed, the user can grasp both of the handle portions 16*a*, 16*b* and move the tool 10 and blade B secured therein along and off of the shaft 104.

To further assist a user in properly positioning the tool 10 around the blade B, at least one of the halves 12, 14 of tool 10 includes one or more alignment members 38. In the embodiment shown in FIGS. 1–6, a single alignment member 38 is secured to half 12, and extends toward half 14. Alignment member 38 is preferably formed integrally with half 12, as shown in FIGS. 1, 2, 4, and 6, although it is understood that the alignment member 38 may be formed as a separate member that is secured to half 12 in any satisfactory manner. Alignment member 38 is preferably located at the inner end of handle portion 16*a*. The alignment member 38 extends outwardly from half 12, and overlaps the opposite half 14 as handle portions 16*a*, 16*b* are moved together to the closed position. Alternatively, the alignment member 38 may be engaged within a recess formed in the opposite half 14, to ensure alignment of the halves 12 and 14 as the halves 12 and 14 are moved together. An alternative construction is illustrated in FIGS. 8 and 9, wherein like reference characters will be used where possible to facilitate clarity. In this embodiment, half 12 includes a pair of alignment members 38, one of which is located toward the inner end of handle portion 16*a* and the other of which is located toward the outer end of handle portion 16*a*. This embodiment functions similarly to the embodiment of FIGS. 1–7, in that alignment members 38 overlap both the inner and outer areas of the opposite handle portion 16*b* as handle portions 16*a*, 16*b* are moved together toward the closed position, to maintain halves 12 and 14 in alignment with each other.

In addition, handle portions 16*a*, 16*b* may be formed to have a complementary construction, to further facilitate alignment of halves 12, 14 as halves 12, 14 are moved together. With reference to FIGS. 1–6, handle portion 16*a* includes an outwardly extending member 54 and handle portion 16*b* includes a recess 56 configured to receive outwardly extending member 54. As handle portions 16*a* and 16*b* are moved together toward the closed position, outwardly extending member 54 is received within recess 56. In combination with the one or more alignment members 38, this construction maintains the halves 12 and 14 in alignment with each other as halves 12 and 14 are moved together to engage blade B with the tool 10, and provides a relatively low profile arrangement that enables a user to easily grip the handles 16*a*, 16*b* and manipulate the tool 10 and the engaged blade B.

The tool 10 also includes a retainer arrangement 40 secured to each of the halves 12, 14 that can releasably maintain halves 12, 14 together in the closed position around the blade B without requiring the user to grip the handle portions 16*a*, 16*b* or to position a separate member around the handle portions 16*a*, 16*b*. The retainer arrangement 40 allows the user to use both hands when releasing the blade B from the shaft 104. In the illustrated embodiment, the retainer arrangement 40 includes a series of teeth 42 disposed on one of the halves, such as half 14, and an engagement member 44 disposed on the other half, such as half 12, in alignment with the teeth 42.

The engagement member 44 is configured to engage teeth 42 in a ratchet-type manner as halves 12, 14 are moved together around the blade B, to maintain tool 10 in a closed position in which the blade B is retained in the tool 10 between the halves 12 and 14. The engagement member 44 includes a body 46 that extends perpendicularly to the handle portion 16*a*. Body 46 defines a locking member 48 at its outer end, which is in alignment with the teeth 42 on handle portion 16*b*. Body 46 further includes a release tab 50 that extends in a direction opposite that of locking member 48. The body 46 is connected to the handle portion 16 by a hinge member 52, which extends between the body 46 and the handle portion 16*a* of half 12 to enable the body 46 to be moved between an operative position and an inoperative position. In the operative position, locking member 48 of engagement member 44 is aligned with and engageable with teeth 42 as halves 12, 14 are moved together. In the inoperative or disengaged position, release tab 50 is manipulated by the user to move engagement member 44 out of alignment with teeth 42. The hinge member 52 biases the body 46 toward the engaged position, so as to enable engagement member 44 to engage teeth 42 as halves 12, 14 are moved together from the open position toward the closed position. The hinge member 52 can be formed of any suitably flexible material, and preferably is integrally formed with both the body 46 and the handle portion 16*a*.

While the retainer arrangement has been illustrated as a ratchet-type latch structure formed integrally with the material of halves 12, 14, it is understood that any other type of suitable retainer arrangement may be employed. For example, and without limitation, the retainer arrangement may be any suitable connector formed separately from the tool 10, such as an elastic band, a latch (not shown) or a spring (not shown), among others.

When it is desired to position a new or replacement blade B on the shaft 104 of the saw, the opposite procedure is employed. More specifically, the replacement blade B is positioned within the tool 10 between spaced-apart sleeve sections 28*a*, 28*b*, and is engaged with the sleeve sections 28*a*, 28*b* by moving the respective handle portions 16*a*, 16*b* toward one another. In this position, the handle portions 16*a* and 16*b* are held together manually or by retainer arrangement 40, and the blade B and the tool 10 are maneuvered to align the blade B with the shaft 104 for placement thereon. Once the blade B is properly positioned on the shaft 104, the user can utilize the tool 10 to hold the blade B in position on the shaft 104 while the nut 100 is secured to the shaft 104 in order to attach the blade B. Once the blade B is securely attached to the shaft 104, the handle portions 16*a* and 16*b* are moved away from one another to disengage the sleeve sections 28*a*, 28*b* from the blade B and to allow removal of the tool 10 from the blade B.

Recesses, such as shown at 58, may be formed on the handle portions 16*a* and/or 16*b*, or in any other location on tool 10, to accept labels (not shown) or other indicia which may illustrate the proper operation of tool 10 or contain appropriate safety warnings concerning the operation of the tool 10, or to receive information pertaining to the trademark or the manufacturer of the tool 10.

While the invention has been shown and described with respect to specific embodiments, it should be understood that various alternatives and modifications are contemplated as being within the scope of the invention. For example, and without limitation, it should be understood that tool 10 may be used to grip circular objects other than saw blades. In addition, it should be understood a device similar to tool 10 may be used to grip objects having a shape other than circular, so long as the configuration of the outer walls of the halves 12 and 14 provides engagement with the object that is adapted to be gripped using the tool 10.

As a further alternative, it is contemplated that the outer engagement walls 32*a*, 32*b* of respective halves 12, 14 may have a shape or curvature that does not specifically correspond to a certain diameter of the blade B or other object to be manipulated using the tool 10. For example, and without limitation, walls 32*a*, 32*b* may be configured such that each wall 32*a*, 32*b* has a radius greater than that of the maximum radius of the circular objects to be manipulated using the tool 10. With this construction, walls 32*a*, 32*b* define a generally oval shape when halves 12, 14 are moved together toward the closed position. This enables tool 10 to be used to engage blades B or other circular objects of varying diameter, and ensures that walls 32*a*, 32*b* positively contact the edges of blade B in at least two spaced locations about the periphery of the blade B.

Various alternatives are contemplated as being within the scope of the following claims particularly pointing out and distinctly claiming the subject matter regarded as the invention.

I claim:

1. An attachment and removal device for an object having first and second oppositely facing side surfaces and an outer edge, comprising:

a first engaging portion having a first handle member;

a second engaging portion having a second handle member, wherein the first and second handle members are pivotably connected together at a first end portion of the device, and wherein the first and second handle members extend from the respective first and second engaging portions toward a second end portion of the device;

wherein the first and second engaging portions are configured to be moved apart by operation of the first and second handle members, respectively, to an open position and moved toward each other to an engaged position for engaging the outer edge of the object;

wherein each engaging portion includes a laterally facing wall configured for placement adjacent the first side surface of the object, and an outer wall that is configured to face the outer edge of the object when the first and second engaging portions are moved toward each other to the engaged position; and object retainer structure associated with the first and second engaging portions and extending inwardly from the outer walls, wherein the object retainer structure is configured to overlie at least an outer area of the second side surface of the object adjacent the outer edge of the object when the first and second engaging portions are moved toward each other to the engaged position.

2. The device of claim 1 wherein the object retainer structure includes at least one tab member associated with each of the first and second engaging portions, wherein each tab member is configured to overlie the outer edge of the object when the first and second engaging portions are moved toward each other to the engaged position.

3. The device of claim 2 wherein the at least one tab member is positioned on the outer wall generally opposite and parallel to the laterally facing wall.

4. The device of claim 1 wherein the outer wall and the laterally facing wall are integrally formed.

5. The device of claim 1 wherein each engaging portion is formed such that the handle member, the laterally facing wall and the outer wall are integrally formed.

6. The device of claim 1 wherein the first engaging portion and second engaging portion each define a recess therein, wherein the recesses define a central opening in the device when the device is in the engaged position.

7. The device of claim 1 further comprising a retainer arrangement releasably connectable between the first engaging portion and the second engaging portion.

8. The device of claim 7 wherein the retainer arrangement is disposed between the first and second handle members.

9. The device of claim 7 wherein the retainer arrangement comprises:

a) a first retainer member disposed on the first engaging portion; and b) a second retainer member disposed on the second engaging portion and releasably engageable with the first retainer member.

10. The device of claim 9 wherein one of the first retainer member and the second retainer member includes a plurality of teeth, and the other of the first retainer member and the second retainer member includes an engagement member engageable with the teeth.

11. The device of claim 10 wherein the second retainer member is movably secured to one of the first and second handle members.

12. An attachment and removal device for a cutting member having first and second oppositely facing side surfaces and an outer edge, the device comprising:

a first engaging portion having a first laterally facing wall portion, a first outer wall portion connected to the first laterally facing wall portion, and a first handle portion connected to the first laterally facing wall portion; and a second engaging portion having a second laterally facing wall portion, a second outer wall portion connected to the second laterally facing wall portion, and a second handle portion connected to the second laterally facing wall portion, wherein the first and second engaging portions are pivotably connected together at a location spaced from the first and second handle portions, and are configured to be moved apart to an open position and moved toward each other to an engaged position;

cutting member retainer structure associated with the first and second engaging portions and extending inwardly from the outer wall portions;

wherein the first and second laterally facing wall portions are configured for placement adjacent to and facing the first side surface of the object and are moved together as the first and second engaging portions are moved toward each other, and wherein the first and second outer wall portions are moved toward the outer edges of the cutting member as the first and second engaging portions are moved toward each other, and wherein the cutting member retainer structure is configured to overlie at least an outer area of the second side surface of the cutting member adjacent the outer edge of the cutting member when the first and second engaging portions are moved toward each other to the engaged position.

13. The device of claim 12 wherein the cutting member retainer structure comprises at least one tab extending from one of the first and second outer wall portions.

14. The device of claim 12 further comprising a retainer arrangement releasably connectable between the first engaging portion and the second engaging portion for selectively securing the first and second engaging portions together when the first and second engaging portions are moved toward each other to the engaged position.

15. The device of claim 13, wherein a tab extends from each of the first and second outer wall portions.

* * * * *